US005941458A

United States Patent [19]

Hartmann

[11] Patent Number: 5,941,458

[45] Date of Patent: Aug. 24, 1999

[54] ROTOR NOZZLE FOR A HIGH PRESSURE CLEANING DEVICE

[75] Inventor: Lothar Hartmann, Oerlinghausen, Germany

[73] Assignee: Suttner GmbH & Co. KG, Bielefeld, Germany

[21] Appl. No.: 09/041,703

[22] Filed: Mar. 13, 1998

[30] Foreign Application Priority Data

| | | | |
|---|---|---|---|
| Mar. 20, 1997 | [DE] | Germany | 297 05 058 |
| May 10, 1997 | [DE] | Germany | 297 08 394 |
| Sep. 26, 1997 | [DE] | Germany | 297 17 124 |

[51] Int. Cl.[6] ..... B05B 3/04

[52] U.S. Cl. ..... 239/381

[58] Field of Search ..... 239/225.1, 240, 239/251, 252, 380, 381

[56] References Cited

U.S. PATENT DOCUMENTS

| | | | |
|---|---|---|---|
| 4,353,507 | 10/1982 | Kah, Jr. | 239/240 |
| 4,708,290 | 11/1987 | Osmond | 239/227 |
| 5,332,155 | 7/1994 | Jager | 239/240 |
| 5,395,053 | 3/1995 | French | 239/227 |
| 5,525,046 | 6/1996 | Hartmann | 239/526 |

FOREIGN PATENT DOCUMENTS

| | | | |
|---|---|---|---|
| 0 252 261 | 1/1988 | European Pat. Off. . | |
| 36 23 368 1 | 9/1987 | Germany . | |
| 38 32 035 A1 | 12/1989 | Germany . | |
| 38 44 614 A1 | 1/1990 | Germany . | |
| 39 02 478 C1 | 7/1990 | Germany . | |
| 44 33 646 C2 | 3/1995 | Germany . | |
| 295 12 768 U1 | 12/1995 | Germany . | |
| 5123613 | 5/1993 | Japan | 239/381 |

*Primary Examiner*—Andres Kashnikow
*Assistant Examiner*—Jorge Bocanegra
*Attorney, Agent, or Firm*—Sixbey, Friedman, Leedom & Ferguson; David S. Safran

[57] ABSTRACT

A rotor nozzle for a high pressure cleaning device has a housing and a rotor disk which is mounted to rotate in the housing and which is exposed to the flow of the cleaning liquid, and with a nozzle carrier located downstream of the rotor disk which carries a nozzle which has an outlet axis that is at an acute angle relative to the axis of rotation of the rotor disk and which, along with nozzle carrier, is moved by the rotor disk on a circular path around its axis of rotation such that the jet of cleaning liquid emerging from nozzle creates a circulating conical envelope. The planetary gear transfers the drive motion of the rotor disk with considerably stepped-down rpm to the nozzle carrier via a sun wheel which is connected to the rotor disk, a planet wheel which is connected to the nozzle carrier, and a ring gear that is formed or located on the inside of the housing in which the planet wheel rolls, driven by the sun wheel. Still further, the nozzle has a spherical front that is supported in a socket-like seal which is attached to the housing and which is open in the middle. The nozzle carrier is inclined in the direction of the outlet axis of the nozzle and the planet wheel of the planetary gear is pivotally mounted on the rear end of the nozzle carrier so as to allow relative rotation between them.

12 Claims, 1 Drawing Sheet

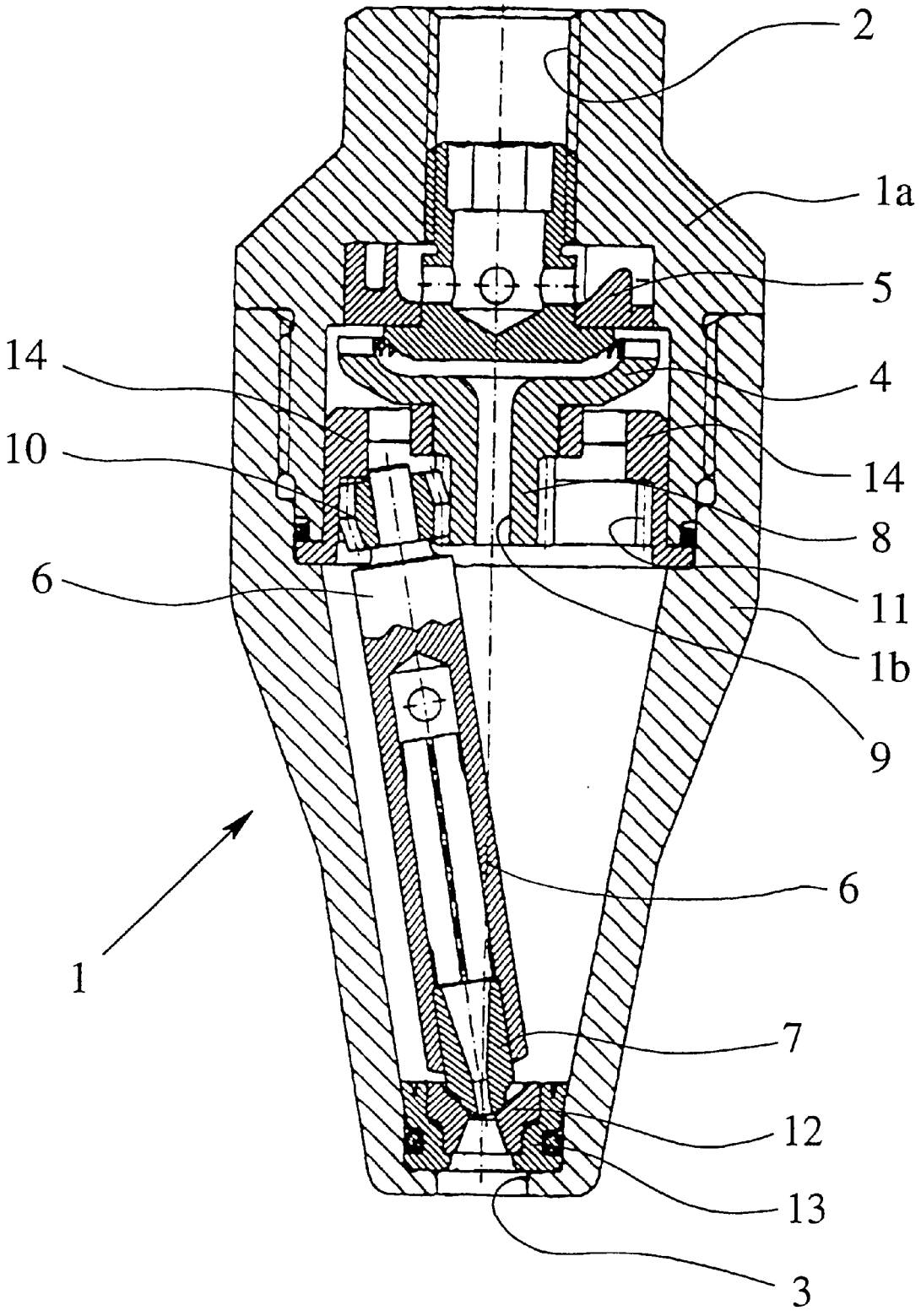
2
1a
5
14
4
10
14
8
6
11
1b
9
6
1
7
12
13
3

ROTOR NOZZLE FOR A HIGH PRESSURE CLEANING DEVICE

BACKGROUND OF THE INVENTION

1. Field of the Invention

The invention relates to a rotor nozzle for a high pressure cleaning device having a housing and a rotor disk which is mounted to rotate in the housing and which is exposed to the flow of the cleaning liquid, and with a nozzle carrier located downstream of the rotor disk which carries a nozzle which has an outlet axis that is at an acute angle relative to the axis of rotation of the rotor disk and which, along with nozzle carrier, is moved by the rotor disk on a circular path around its axis of rotation such that the jet of cleaning liquid emerging from nozzle creates a circulating conical envelope. More specifically, the invention relates to such a device in which a planetary gear transfers the drive motion of the rotor disk with considerably stepped-down rpm to the nozzle carrier via a sun wheel which is connected to the rotor disk, a planet wheel which is connected to the nozzle carrier, and a ring gear that is formed or located on the inside of the housing in which the planet wheel rolls, driven by sun wheel. Still further, the invention relates to such a device in which the nozzle has a spherical front that is supported in a socket-like seal which is attached to the housing and which is open in the middle.

2. Description of Related Art

A rotor nozzle for a high pressure cleaning device of the type which the present invention is based upon is known from German Utility Model No. DE 295 12 768. It has a planetary gear with a seated planet carrier which is joined to the housing. The nozzle is prestressed axially in the direction of the seal by means of a spring element in the nozzle carrier. The nozzle carrier sits in the housing, extending like a type of sleeve around the planetary gear, and forms the ring gear of the planetary gear. This has the flow engineering advantages explained there; but, the construction is complex to build and should be simplified.

In the known rotor nozzle described above, the nozzle carrier can also be joined to the planet carrier, in which case the ring gear has to be located stationary on the inside of the housing. In this case, the planet carrier is likewise encompassed in the manner of a sleeve by the nozzle carrier. The cleaning liquid flowing along the axis of the sun wheel through a flow channel would likewise immediately enter the nozzle carrier in a manner advantageous to flow.

A rotor nozzle for a high pressure cleaning device without a gear is also known (EP 0 252 261 B1) in which the nozzle is located in a stilt which itself is aligned at an angle to the axis of rotation of the rotor disk in the housing and has a spherical front end which is supported in a socket which is held on the housing and which is open in the middle, while on the opposite, rear end, it is driven by a driver which is located at a radial distance from the axis of rotation and which is joined to the rotor disk. This driver allows rotation of the stilt which is freely rotatable around its longitudinal axis relative to the driver. The purpose of this free rotation is that the support surface of the stilt in the socket-like seal does not turn with the same rpm of the rotor disk itself which is very high under certain circumstances. These rpm under certain circumstances are so high that they must be limited by brake elements. For this reason, this structure possesses centrifugal force brake elements.

A rotor nozzle is also known for a high pressure cleaning device (DE 44 33 646 C2) in which the nozzle, arranged on a stilt serving as the nozzle carrier, is not driven by gears, but instead is moved directly by the cleaning liquid, therefore by flow mechanics. Here, the rear end of the nozzle carrier has a roll ring which projects radially outward, which is pivotally mounted thereon, and which rolls on the inside housing wall. This likewise is designed for decoupling the inherent rotation of the nozzle body, which occurs in operation from the peripheral rotation of the nozzle body against the housing inner wall, in order to reduce wear on the socket-like seal.

SUMMARY OF THE INVENTION

The primary object of the present invention is to structurally simplify the initially described, known rotor nozzle with the planetary gear.

This object is achieved in a rotor nozzle of the initially mentioned type by the nozzle carrier being inclined in the direction of the outlet axis of the nozzle and is pivotally mounted to the planet wheel of the planetary gear on its rear end. The end of the nozzle carrier forms the bearing axis of the planet wheel of the planetary gear. Thus, there is a minimized planetary gear in which, by the support of the planet wheel on the end of the nozzle carrier which acts in this regard as an axle, decoupling of the inherent rotation of the nozzle carrier, which occurs during operation from the peripheral rotation of the nozzle carrier depending on the step down ratio of the gear, is easily ensured.

In the most common case, the planetary gear is made as a toothed gearing. However, it is also fundamentally possible to design the planetary gear as a friction gear, for example, with a hard rubber roller on the end of the nozzle carrier serving as the planet wheel.

Furthermore, making the housing out of aluminum has special weight advantages, i.e., with a high performance rotor nozzle of this type, an individual can work much longer than with the rotor nozzles currently on the market.

BRIEF DESCRIPTION OF THE DRAWINGS

The sole figure of the drawings shows one preferred embodiment of a rotor nozzle for a high pressure cleaning device in accordance with the present invention.

DETAILED DESCRIPTION OF THE PREFERRED EMBODIMENTS

A rotor nozzle of the type under consideration is conventionally located at the tip of a cleaning lance (not shown) for a high pressure cleaning device, for example, of the type shown in U.S. Pat. No. 5,525,046. The rotor nozzle shown has a two-part housing 1 which comprises an inlet part 1*a* and an outlet part 1*b* which are screwed together and which are sealed relative to one another, such as by the O-ring seal represented. Inlet part 1*a* has a water inlet 2, and outlet part 1*b* has water outlet 3. An inner cavity is formed in the housing 1, within which there is a rotor disk 4, and a flow insert 5 which is used for routing the flow to rotor disk 4 and which guides the water entering at water inlet 2, via the corresponding channels, onto the rotor disk 4. In the embodiment shown, the rotor disk 4 has a flow channel 9 in its center for the water flowing under high pressure.

Downstream of rotor disk 4 is a nozzle carrier 6 with a nozzle 7; its outlet axis forms an acute angle with respect to the axis of rotation of the rotor disk 4 (represented by a broken line). The nozzle carrier 6, along with nozzle 7, is moved by rotor disk 4 on a circular path around the axis of rotation of the rotor disk (translation on a circular path), such that the jet of cleaning liquid emerging from nozzle 7 circulates along a conical envelope. Nozzle carrier 6 is longitudinally elongated, here, being made in the manner of a stilt into which the nozzle 7 is inserted as a separate part. This is for reasons of material selection. Basically, it would also be possible for the nozzle 7 to be made in one piece with the nozzle carrier 6.

The drive motion of rotor disk 4 is transferred, with a considerably stepped-down rpm, to nozzle carrier 6 by a planetary gear having a sun wheel 8 which is connected to rotor disk 4. Furthermore, a planet wheel 10 engages the sun wheel 8 and rolls in a ring gear 11.

Nozzle 7 has a spherical front end which is supported in a socket-like seal 12 which is attached to housing I and which is open in the middle. The seal 12, itself, is made of highly wear-resistant material and is inserted into an insert 13 at water outlet 3.

The ring gear 11 of the planetary gear is located on the inside of housing 1, and in the embodiment shown, is formed on the gear insert 14, which is inserted and clamped between inlet part 1*a* and outlet part 1*b* of housing 1. Ring gear 11 can also be formed on the inside of housing 1. Nozzle carrier 6 is inclined forwardly toward the water outlet 3. On the rear end of the nozzle carrier 6, i.e., on the end facing away seal 12, the planet wheel 10 of the planetary gear is pivotally mounted.

Since the rotor disk 4 is joined to the sun wheel 8, the sun wheel 8 turns at the same speed as the rotor disk 4. High speed rotation of rotor disk 4, reduced via the step-down ratio of the planetary gear, for example, a step-down ratio of 6:1, causes slow rotation of planet wheel 10 around sun wheel 8. This causes rotation of the water jet emitted from nozzle 7 in nozzle carrier 6 along a conical envelope.

The structure of the rotor nozzle shown is simple in spite of the use of a step-down gear in the form of a planetary gear.

For reasons of gear engineering, it could be provided that planet wheel 10, which is supported by nozzle carrier 6, is combined with at least one more planet wheel, preferably two additional planet wheels, which travel freely, preferably in a planet carrier. The lateral pressure on sun wheel 8 caused by the planet wheel 10 would then be balanced and is feasible from a gear engineering standpoint.

The embodiment shown illustrates the planetary gear as a toothed gearing. However, the planetary gear could also be made as a friction gear, for example, with the planet wheel 10 being formed as a hard rubber roller which is pivotally mounted on the end of nozzle carrier 6.

As in the prior art underlying the invention, the nozzle 7 in nozzle carrier 6 need not be rotatable around its own longitudinal axis, but can be movable in the axial direction relative to the nozzle carrier 6. A rotation capacity of nozzle 7 in nozzle carrier 6, due to the possible inherent rotation of nozzle carrier 6 relative to planet wheel 10, is unnecessary. The axial movement capacity of nozzle 7 in nozzle carrier 6 has the advantages already explained in the prior art with respect to operation and production tolerance. Prestress by means of a spring element in a manner known from the prior art could be provided.

It can be advantageous to provide a flow insert 5 which directs the water entering at water inlet 2 via corresponding channels (not shown) onto the rotor disk 4 and that the number and arrangement of water passages in flow insert 5 can be selected to be different, optionally by selection of different flow inserts 5 in order to determine the rotational speed of the rotor disk 4.

It is especially preferred that housing 1 be made of aluminum, especially an aluminum alloy. In this embodiment, it is provided that the nozzle carrier 6 does not contact the inner surface of housing 1 during rotation. Furthermore, in the embodiment shown, it is provided that the ring gear 11 of the planetary gear, which transfers the drive motion of rotor disk 4 to nozzle carrier 6, is provided as a separate, wear-resistant part on housing 1. Here, the corresponding insertion part is specifically a gear insert 14. The gear insert 14 can also be made of a highly wear-resistant material, especially a corresponding metal, while the housing otherwise, at least housing part 1*b*, is made of aluminum.

Also, in a rotor nozzle with nozzle carrier 6 which rotates in contact with the inner wall of housing 1, especially without an interposed gear, housing 1 could be made of aluminum, if the contact path of the nozzle carrier 6 is made suitably wear-resistant, such as by being coated or provided with an insert.

While only a single embodiment in accordance with the present invention have been shown and others described, it is understood that the invention is not limited thereto, and the invention is susceptible to numerous changes and modifications as known to those skilled in the art. Therefore, this invention is not limited to the details shown and described herein, and includes all such changes and modifications as are encompassed by the scope of the appended claims.

I claim:

1. A rotor nozzle for a high pressure cleaning device comprising a housing, a rotor disk which is rotatably mounted in the housing and which is exposed to a flow of the cleaning liquid from an inlet of the housing, a nozzle carrier located downstream of the rotor disk, and a nozzle having an outlet axis which forms an included acute angle relative to an axis of rotation of the rotor disk and a spherical front end supported in a socket-like seal which is attached to an outlet end of the housing and which is open in the middle, said nozzle being movable along with the nozzle carrier on a circular path around the axis of rotation of the rotor disk in a manner causing a jet of cleaning liquid emerging from the nozzle to circulate on a conical envelope by a planetary gear and the rotor disk, the planetary gear transferring motion of the rotor disk with a stepped-down rpm to the nozzle carrier by a sun wheel of the planetary gear being connected to the rotor disk and a planet wheel of the planetary gear being connected to the nozzle carrier, and a ring gear being disposed on an inner side of the housing, in which the planet wheel rolls, driven by the sun wheel; wherein the nozzle carrier extends in the direction of the outlet axis of nozzle; and wherein the rear end of the nozzle carrier is rotatably connected to the planet wheel of the planetary gear.

2. Rotor nozzle as claimed in claim 1, wherein the nozzle is mounted within the nozzle carrier.

3. Rotor nozzle as claimed in claim 1, wherein the planetary gear is provided with at least one freely rotatable planet wheel in addition to the planet wheel to which the nozzle carrier is rotatably connected.

4. Rotor nozzle as claimed in claim 3, wherein the planetary gear is provided with two freely rotatable planet wheels in addition to the one planet wheel to which the nozzle carrier is rotatably connected, the three planet wheels being arranged in a triangular pattern around the sun wheel.

5. Rotor nozzle as claimed in claim 1, wherein the planetary gear comprises a toothed gearing.

6. Rotor nozzle as claimed in claim 1, wherein the planetary gear comprises a friction gear.

7. Rotor nozzle as claimed in claim 1, further comprising a flow insert which directs fluid entering the inlet of the housing onto the rotor disk, said flow insert being a means for determining the rotational speed of the rotor.

8. Rotor nozzle as claimed in claim 1, wherein the housing is made of a metal selected from the group consisting of aluminum or an aluminum alloy.

9. Rotor nozzle as claimed in claim 8, wherein the nozzle carrier is arranged so as to be free of contact with the inner side of the housing.

10. Rotor nozzle as claimed in claim 8, wherein the ring gear of the planetary gear which transfers the drive motion of the rotor disk to the nozzle carrier is a separate, wear-resistant part mounted to the housing.

11. A rotor nozzle for a high pressure cleaning device comprising a housing, a rotor disk which is rotatably mounted in the housing and which is exposed to a flow of the cleaning liquid from an inlet of the housing, a nozzle carrier located downstream of the rotor disk, and a nozzle having an outlet axis which forms an included acute angle relative to an axis of rotation of the rotor disk and a spherical front end supported in a socket-like seal which is attached to an outlet end of the housing and which is open in the middle, said nozzle being movable along with the nozzle carrier on a circular path around the axis of rotation of the rotor disk in a manner causing a jet of cleaning liquid emerging from the nozzle to circulate on a conical envelope, wherein the housing is made of a metal selected from the group consisting of aluminum or an aluminum alloy.

12. Rotor nozzle as claimed in claim 11, wherein the nozzle carrier is arranged so as to be free of contact with the inner side of the housing.

* * * * *